US006857944B2

(12) United States Patent
Linde et al.

(10) Patent No.: US 6,857,944 B2
(45) Date of Patent: Feb. 22, 2005

(54) METHOD FOR FILLING A PRESSURE CONTAINER AND DEVICE FOR PRODUCING A JET OF A SUSPENSION

(75) Inventors: Marco Linde, Stockelsdorf (DE); Thorsten Rentsch, Lübeck (DE)

(73) Assignee: ANT Applied New Technologies AG, Lubeck (DE)

( * ) Notice: Subject to any disclaimer, the term of this patent is extended or adjusted under 35 U.S.C. 154(b) by 0 days.

(21) Appl. No.: 10/189,109

(22) Filed: Jul. 2, 2002

(65) Prior Publication Data

US 2004/0005849 A1 Jan. 8, 2004

(51) Int. Cl.[7] ..... B24C 3/00
(52) U.S. Cl. ..... 451/75; 451/38; 451/99
(58) Field of Search ..... 451/88, 38–40, 451/60, 75, 99, 100

(56) References Cited

U.S. PATENT DOCUMENTS

| | | | | | |
|---|---|---|---|---|---|
| 3,323,257 | A | * | 6/1967 | Fonti | 451/75 |
| 3,791,078 | A | * | 2/1974 | Fleisher | 451/67 |
| 4,487,582 | A | * | 12/1984 | Warrin | 433/88 |
| 4,494,932 | A | * | 1/1985 | Rzewinski | 433/88 |
| 4,862,649 | A | * | 9/1989 | Davis et al. | 451/38 |
| 4,909,556 | A | * | 3/1990 | Koskinen | 296/10 |
| 5,207,034 | A | * | 5/1993 | Lynn | 451/88 |
| 5,283,991 | A | * | 2/1994 | Keizers | 451/101 |
| 5,643,058 | A | * | 7/1997 | Erichsen et al. | 451/99 |
| 5,722,801 | A | * | 3/1998 | Mahoney, Jr. | 406/24 |
| 5,782,673 | A | * | 7/1998 | Warehime | 451/2 |
| 5,908,349 | A | * | 6/1999 | Warehime | 451/102 |
| 6,077,152 | A | * | 6/2000 | Warehime | 451/75 |
| 6,123,602 | A | * | 9/2000 | Rodriguez et al. | 451/5 |
| 6,152,810 | A | * | 11/2000 | Drenter | 451/75 |
| 6,390,898 | B1 | * | 5/2002 | Pieper | 451/75 |

FOREIGN PATENT DOCUMENTS

| | | |
|---|---|---|
| EP | 0 514 945 A1 | 11/1992 |
| WO | WO 87/02290 | 4/1987 |
| WO | WO 99/14015 | 3/1999 |

* cited by examiner

*Primary Examiner*—David B. Thomas
(74) *Attorney, Agent, or Firm*—Jacox Meckstroth & Jenkins

(57) ABSTRACT

The method for filling a pressure container and a device for producing a jet of a suspension: The method serves for filling a pressure container (10) of a device for producing a jet of a suspension of a carrier fluid (1) and an abrasive medium (9), with an abrasive medium. The abrasive medium (9) is filled from a filling container (18) arranged above the pressure container (10) via a conduit (19) opening out into the pressure container (10) near to the upper side, by gravity from the filling container (18) into the pressure container (10), wherein the carrier fluid (1) displaced into the pressure container (10) by the abrasive medium (9) is discharged from the pressure container (10).

12 Claims, 1 Drawing Sheet

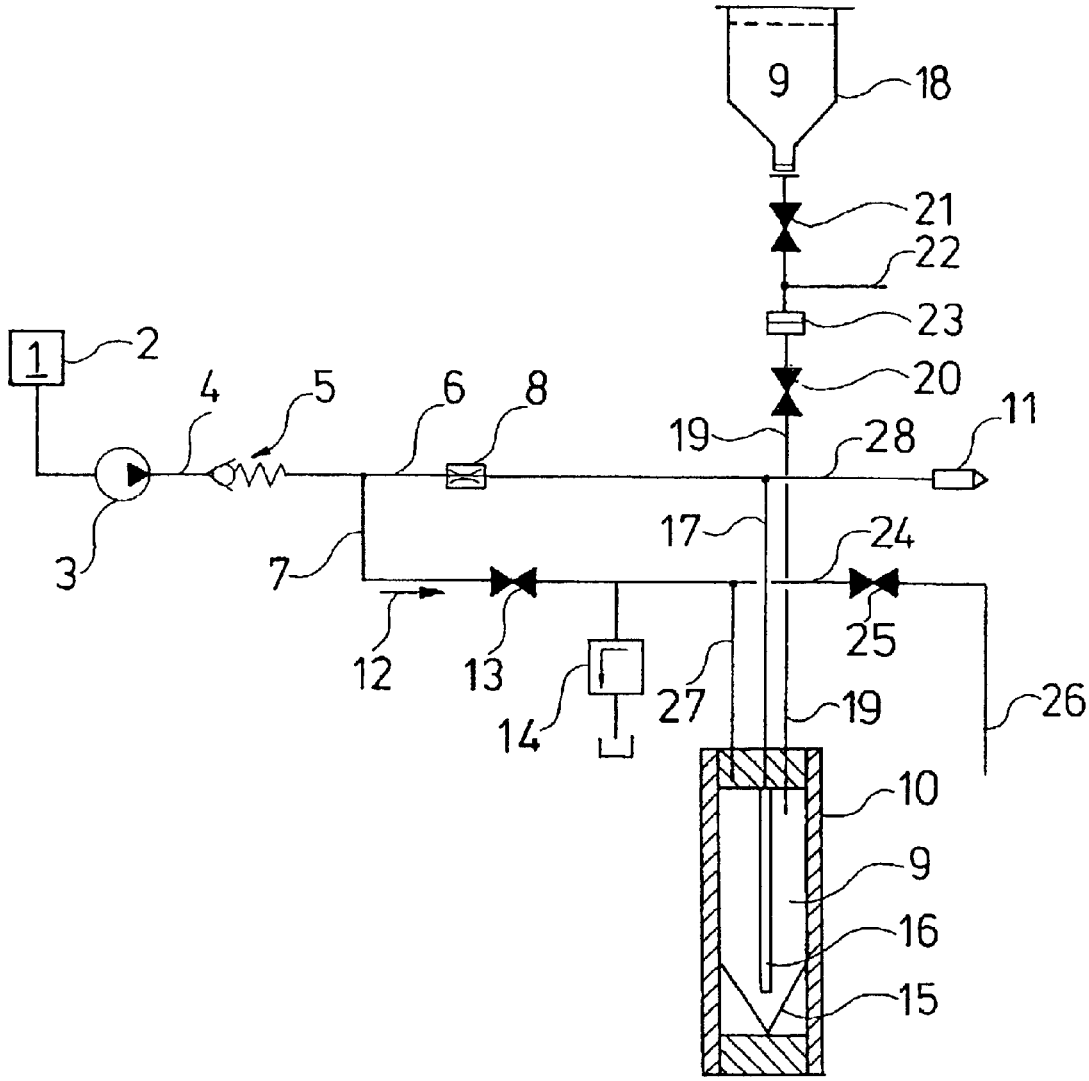
9
18
21
22
23
20
1
2
4
5
6
8
19
28
11
3
7
17
24
12
13
25
14
27
19
26
10
9
16
15

METHOD FOR FILLING A PRESSURE CONTAINER AND DEVICE FOR PRODUCING A JET OF A SUSPENSION

BACKGROUND OF THE INVENTION

The present invention relates to the technical field of water abrasive suspension blasting (WASB) and here particularly to the bypass principle for producing WASB. Water abrasive suspension blasting is used for example in degrading technology below and above water. With this for example projectile casings are degraded in order to be able to remove and dispose of explosive substances located therein whilst avoiding flying sparks. The water abrasive suspension blasting has also shown to be successful with the degrading of atomic power stations, in particular on degrading the pressure container. Further fields of application are offshore technology, as well as in the field of petrochemical industry when it is the case of separation in an environment endangered by explosion.

The devices functioning according to the bypass principle consist essentially of a high-pressure pump which conveys water as a carrier fluid into a main conduit with a throttle member, and parallel into a secondary conduit (bypass). The secondary conduit opens out into a pressure container in which the abrasive medium is located, wherein the fluid flow led in the secondary conduit goes through the pressure container, entrains abrasive medium here and via a conduit out of the pressure container is again supplied to the main conduit. This suspension is delivered via a dispensing nozzle which via a flexible conduit may be arranged where necessary several hundred metres away from the device.

Whilst the carrier fluid is available from a supply container or the water supply network mostly in an adequate quantity over a longer time for the continuous operation of the device, the quantity of abrasive medium which is available is dependent on the size of the pressure container. If the abrasive medium located in the pressure container is used up the pressure container must be filled and the water abrasive suspension blasting must be interrupted during this time.

Although there are known devices which alternately operate with two pressure containers so that a continuous operation is possible, the expense with regard to apparatus is very great. Furthermore pressure fluctuations occur during the change or switch-over of the pressure container so that also here a continuous operation is not possible.

From EP 0 276 219 B1 there is known a device of the known type with which there is provided only one pressure container in which before being filled the high-pressure pump is switched off and thus the suspension jet is interrupted. For filling there is provided a circulatory path in which the abrasive medium together with fluid from a supply container is pumped into the pressure container and from here again into the supply container. At the same time the leading of the conduit through the pressure container is designed such that the abrasive medium settles in this, whereas the fluid is led running back into the supply container. The construction of the circulatory path decoupled from the main flow for filling the pressure container, is likewise expensive with regard to apparatus. The fittings provided within the circulatory path must with regard to design be formed such that they are not compromised in their function by the abrasive medium which compellingly settles here.

BRIEF SUMMARY OF THE INVENTION

Against this state of the art it is the object of the present invention to provide a method for filling a pressure container with which this may be filled simply, quickly and with little expense with regard to apparatus. Furthermore there is also be provided a suitable device with which this method may be carried out, which is inexpensive in manufacture and which with regard to its design is largely protected from deposits of abrasive medium.

In one aspect, this invention comprises a method for filling a pressure container of a device for producing a jet of a suspension of a carrier fluid and an abrasive medium, with abrasive medium, wherein the abrasive medium, from a filling container arranged above the pressure container, via a conduit opening into the pressure container near to the upper side, is filled by gravity from the filling container into the pressure container, wherein the carrier fluid displaced in the pressure container by the abrasive medium is discharged out of the pressure container.

In another aspect of the invention, the invention comprises a device for producing a jet of a suspension of a carrier fluid and an abrasive medium, comprising a high-pressure pump which delivers the carrier fluid into a main conduit to a dispensing nozzle, a pressure container; and a filling container for abrasive medium; said filling container being in fluid communication with said pressure container and arranged to feed said pressure container by gravity.

Advantageous formations of the invention are specified in the dependent claims, the subsequent description as well as in the drawings.

The basic concept of the present invention is to omit the circulatory path known from the state of the art for filling the pressure container with abrasive medium, and instead of this to provide a gravity delivery which makes do without an expensive pump prone to wear and which by way of a low number of stop valves may be inexpensively incorporated into the device. For this there is provided a filling container (hopper) from which the abrasive medium located therein may get into the pressure container by way of gravity. The filling container must therefore be arranged above the pressure container, wherein the abrasive medium gets into the pressure container via a down conduit which leads from the lower region of the filling container to the upper region of the pressure container. Basically the abrasive means to be filled as such may get from the downwardly conically tapering filling container into the down conduit and subsequently into the pressure container, usefully however also a carrier fluid such as for example water is added to the abrasive medium in the filling container in order to simplify the delivery procedure caused by gravity.

Since the abrasive medium located in the pressure container, at the end of the operation is replaced by water, on refilling this with abrasive medium this is not empty but filled with water, thus not only does abrasive medium have to be filled into the container, but the corresponding quantity of water with regard to volume must be led out. In the simplest form this is likewise effected by the down conduit itself. Preferably however there is provided a separate conduit for removal of the displaced carrier fluid, so that on filling, the mass flow of the abrasive medium is not reduced in speed by the rising flow of the displaced carrier fluid. Thus with the provision of a separate discharge conduit one may achieve considerably greater filling speeds.

In order to prevent the suspension or carrier fluid from getting into the filling container with normal delivery operation, a stop valve is provided in the down conduit. A corresponding stop valve must then also be provided in the discharge conduit if such is provided. At the same time a part of the secondary conduit which opens into the pressure container may serve as a discharge conduit. It is to be understood that the stop valve must the lie outside the region of the secondary conduit. By way of this measure the number of conduits opening into the pressure container may be minimised, which is already advantageous for static reasons.

The down conduit between the filling container and the pressure container should run largely perpendicular since then the weight force of the abrasive medium to be refilled acts in the delivery direction, and blockages of the conduits may be avoided. Indemic to the system, it is useful for the down conduit from the base of the filling container to open out essentially parallel and in a straight line into the lid or the upper side of the pressure container. However for static reasons or for other reasons it may be necessary to displace the location of the orifice. In these cases one must take into account the fact that the opening of the down conduit into the pressure container is to lie as far as possible to the top and the opening for the down conduit into the filling container to lie as far as possible to the bottom.

In order to be able to deliver the abrasive medium as completely as possible out of the pressure container, it is useful to form the pressure container on the side of the base in the manner of a funnel, thus tapering downwards and to form the part of the secondary conduit which leads the abrasive medium into the main flow such that this part of the discharging secondary conduit opens out at a small distance over the base. At the same time it is particularly favourable when this discharging secondary conduit is formed as an essentially perpendicular riser pipe within the pressure container which at least in its opening region is arranged centrally with respect to the tapering of the base. In order to ensure that for the unlikely but possible case that during a filling procedure one attempts to fill more abrasive medium into the pressure container than this may accommodate with respect to volume, and then the excess abrasive medium lies in the down conduit, in a further formation of the invention one envisages arranging two stop valves in the down conduit in series behind one another and letting a rinsing conduit be connected there between. Then with a blockage of abrasive material in the down conduit, firstly the stop valve closer to the filling container is closed, whereupon via the rinsing conduit carrier fluid is led under pressure into the system so that at the end of the rinsing procedure the stop valve close to the pressure container including the down conduit as well as the discharge conduit together with valve is free of abrasive medium. Only then are the remaining stop valves closed, specifically the stop valve on the side of the pressure container in the down conduit as well as the further valve in the discharge conduit. With the latter valves it is the case of high pressure valves, which on account of design are particularly prone to deposits of abrasive medium on the valve seats.

It is particularly advantageous when the filling container is designed as an exchange container, since then for exchange one only needs to change an empty one for a completely filled filling container without having to deal with abrasive medium within the device. In this case it is useful to provide a mechanical coupling in the down conduit, and specifically directly behind the stop valve on the side of the filling container. The filling container may then be designed as an exchange container so that an emptied filling container may be replaced by a full filling container in a simple manner.

Other objects and advantages of the invention will be apparent from the following description, the accompanying drawings and the appended claims.

BRIEF DESCRIPTION OF THE DRAWINGS

The invention is hereinafter described by way of one embodiment example shown in the drawing. The single FIGURE shows the construction of a device according to the invention in the form of a simplified hydraulic connection diagram.

DETAILED DESCRIPTION OF THE INVENTION

The device shown in the FIGURE serves for producing a jet of a suspension of carrier fluid, as a rule water, and an abrasive medium, for example corundum or river sand under high pressure. The carrier fluid 1 from a container 2 or a (non-shown) supply network is led to a high pressure pump 3 which typically produces a pressure between 200 and 2000 bar and more on the output side. Via a conduit 4 the carried fluid 1 under a high pressure is delivered by the pump 3 through a return valve 4 parallel into a main conduit 6 as well as a secondary conduit 7. In the main conduit there is provided a throttle member 8 which is dimensioned and set such that apart from a main flow forming in the main conduit on operation, a secondary flow through the secondary conduit sets in, which accommodates abrasive medium 9 located in a pressure container and leads this to the main flow in order then as a total flow under pressure at a dispensing nozzle to form a jet of a suspension of carrier fluid 1 and abrasive medium 9.

The secondary conduit 7 in the delivery direction 12 of the secondary flow flowing through this comprises a stop valve 13 as well as a safety means 14 which opens on exceeding a predetermined maximum pressure. The secondary conduit 7 opens out into the upper side of the pressure container 10. The pressure container 10 comprises a roughly conically downwardly tapering base 15 over whose lowest point at a small distance to this there opens out a riser pipe which is connected to the main conduit 6 via a conduit 17. The conduit 17 is part of the secondary conduit 7. After leading together the main and auxiliary conduits 6,7 the suspension formed of carrier fluid 1 and abrasive medium 9 then flows via a conduit 28 to the dispensing nozzle 11. The conduit 26 connects the essentially stationary part of the device to the dispensing nozzle 11 arranged movable to this and may be several hundred metres long. Stationary within the context of the invention means that the device is stationary in operation, but that basically this is transportable, for example on a vehicle or in a container or load structure.

As soon as the filling level of the pressure container 10 with abrasive means falls below the opening region of the riser pipe 16, no more abrasive medium is delivered, the pressure container 10 is then to be refilled. For this there is provided a filling container 8 which via a down conduit 19 is connected to the pressure container 10. The down conduit 19 is arranged essentially perpendicular and opens out into the upper side of the pressure container but at a small distance below the upper side in the inside, thus below the opening of the secondary conduit 7 into the pressure container 10. In the down conduit 19 there is provided a high pressure stop valve 20 as well as a further stop valve 21 allocated to the filling container 18. Between these two stop valves 20 and 21 connected in series there runs in a rinsing conduit 22. Furthermore between the stop valves 20 and 21 there is provided a coupling 23. The filling container 18 is designed as an exchange container and may together with the stop valve 21 via the coupling 23 be separated from the remaining device in order to exchange an empty one for a full filling container 18 or to remove the filling container for transport purposes. The rinsing conduit 22 is connected via a tubing coupling which is not shown, and may therefore likewise be separated from the filling container 18.

Furthermore there is provided a discharge conduit 24 which connects the part of the secondary conduit 7 leading to the pressure container 10, via a high pressure stop valve 25 to a conduit 26 opening out into the surroundings or into a collecting container.

For refilling abrasive medium 9 firstly the stop valve 13 is closed, then the high pressure pump 3 is switched off and the stop valve 25 is opened. The filling container 18 which has previously been connected to the device by way of the coupling 23 and filled with abrasive medium 9 is conductingly connected to the inside of the pressure container 10 by opening the valves 21 and 20. The abrasive medium 9 which is located in the filling container and which is considerably heavier than the water located in the pressure container 10 flows by way of its intrinsic weight, with the carrier fluid likewise located in small quantities in the filling container, into the inside of the pressure container 10. The water displaced in the pressure container 10 by way of this rises through the conduit 27 which according to valve position forms part of the secondary conduit 7 or part of the discharge conduit 24, gets into the discharge conduit 24, via the opened valve 25 into the conduit 26 and then into the surroundings.

The filling container 18 is dimensioned such that the abrasive medium 9 located therein may be completely filled into the pressure container 10 so that after emptying the filling container 18 only the stop valves 20, 21 and 25 need to be closed, the high pressure pump 3 switched on and then the stop valve 13 opened, in order to set the device again in the condition envisaged for producing a high pressure jet of the suspension. The high pressure valve 20 with regard to design is formed such that here no abrasive medium settles so that this conveyed by gravity passes through up to into the pressure container 10. Only carrier fluid flows via the high pressure valve 25 so that this valve likewise is not loaded with abrasive medium or its deposits.

If on account of an erroneous operation one proceeds with the filling procedure before the pressure container 10 has reached its minimum filling level envisaged for this, it may occur that in the filling container 18 there is located more abrasive medium 9 than the pressure container may accommodate. As soon as the filling level of the abrasive medium in the pressure container 10 has reached the height in which the down conduit 19 opens out into the pressure container 10, no further delivery of abrasive material into the pressure container 10 is effected, instead of this the abrasive medium dams in the conduit 19. If this is the case, firstly the stop valve 21 is closed. With this it is the case of a low pressure valve which is largely insensitive to deposits of abrasive medium. Then with opened valves 20 and 25 rinsing fluid is introduced via the conduit 22 by which means the abrasive medium located in the down conduit 19 is delivered into the pressure container 10 by way of the pressure of the rinsing fluid. The height of the opening of the down conduit 19 into the pressure container 10, taking into account the volume of the down conduit 19 and the remaining residual volume in the pressure container 10 is dimensioned such that the abrasive medium located in the down conduit 19 may still be completely pumped into the pressure container 10 without abrasive medium exiting via the conduits 27, 24 and 26. By way of this the high pressure valve 25 is largely kept free of abrasive medium, even in the previously outlined case of an "overfilling". On account of the opening of the down conduit 9 into the pressure container, displaced downwards with respect to the conduit 27 it is ensured that also with a subsequent rinsing procedure no abrasive medium 9 may be rinsed out of the pressure container 10. The coupling 23 and the sensitive high pressure valve 20 in contrast are cleaned by the rinsing fluid and may be subsequently actuated without being subjected to wear and leakage on account of deposits of abrasive material. For rinsing via the rinsing conduit 22 a low pressure is sufficient as is usually present in the stationary supply network or may be made available by way of circulatory pumps without further ado.

The device described here except for the constantly required high pressure pump 3 requires no further expensive pumps, neither for the filling procedure nor even for the rinsing procedure which in any case is not required.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A method for filling a pressure container of a device for producing a jet of a suspension of a carrier liquid and an abrasive medium, with said abrasive medium, said method comprising the steps:

filling said the abrasive medium by gravity from a filling container arranged above and coupled to the pressure container via a conduit opening into the pressure container near to an upper side thereof, wherein the carrier liquid displaced in the pressure container by the abrasive medium is discharged out of the pressure container without the use of air in the pressure container.

2. A device for producing a jet of a suspension of a carrier liquid and an abrasive medium, with a high-pressure pump coupled to a main conduit, said high pressure pump delivering said carrier liquid into said main conduit that comprises a throttle member, and parallel into a secondary conduit, wherein the secondary conduit leads through the pressure container again to the main conduit and at the end of the main conduit there is provided a dispensing nozzle, wherein above the pressure container there is provided a filling container for abrasive medium which, via a down conduit, is connected to the pressure container, wherein there are provided means for controlling flow of said abrasive medium through said down conduit, said pressure container not comprising any air during dispensing or filing of said pressure container.

3. The device as recited in claim 2, wherein there is provided a discharge conduit via which the carrier fluid which is located in the pressure container and is displaced on filling the abrasive medium may be discharged, wherein there are provided means for controlling fluid through said discharge conduit.

4. The device as recited in claim 2, wherein a part of a secondary conduit forms part of the discharge conduit.

5. A method for filling a pressure container of a device for producing a jet of a suspension of a carrier liquid and an abrasive medium, with abrasive medium, said method comprising the steps:

filling said the abrasive medium by gravity from a filling container arranged above and coupled to the pressure container via a conduit opening into the pressure container near to an upper side thereof, wherein the carrier liquid displaced in the pressure container by the abrasive medium is discharged out of the pressure container without the use of air in the pressure container; and wherein said down conduit runs essentially from said filling container to said pressure container and opens out at a distance below the opening of a discharge conduit in the pressure container to permit said pressure container to be filled by gravity.

6. A method for filling a pressure container of a device for producing a jet of a suspension of a carrier liquid and an abrasive medium, with abrasive medium, said method comprising the steps:

filling said the abrasive medium by gravity from a filling container arranged above and coupled to the pressure container via a conduit opening into the pressure container near to an upper side thereof, wherein the carrier liquid displaced in the pressure container by the abrasive medium is discharged out of the pressure container without the use of air in the pressure container; and wherein the pressure container in the inside is formed tapering towards a base and that a discharging secondary conduit in the tapering region opens out at a distance above said base.

7. The device according to claim 2, wherein a discharging secondary conduit within the pressure container is formed essentially as a riser pipe.

8. A method for filling a pressure container of a device for producing a jet of a suspension of a carrier liquid and an abrasive medium, with abrasive medium, said method comprising the steps:

filling said the abrasive medium by gravity from a filling container arranged above and coupled to the pressure container via a conduit opening into the pressure container near to an upper side thereof, wherein the carrier liquid displaced in the pressure container by the abrasive medium is discharged out of the pressure container without the use of air in the pressure container; and wherein in the conduit between the filling container and the pressure container, two stop valves in series, wherein between said two stop valves there connects a rinsing conduit for rinsing at least one of said two stop valves.

9. The device according to claim 2, wherein said down conduit comprises at least two stop valves and a coupling between said two stop valves for separating the filling container from the pressure container.

10. The device according to claim 2, wherein the filling container an exchange container.

11. A method for filling a pressure container of a device for producing a jet of a suspension of a carrier fluid and an abrasive medium, with the abrasive medium, comprising the steps of:

situating a filling container to gravity feed the pressure container via a conduit coupling said filling container and said pressure container until carrier fluid displaced in the pressure container by the abrasive medium is discharged out of the pressure container, without the use of air.

12. A device for producing a jet of a suspension of a carrier liquid and an abrasive medium, comprising:

a high-pressure pump which delivers the carrier liquid into a main conduit to a dispensing nozzle;

a pressure container coupled to said high-pressure pump; and a filling container coupled to said pressure container for storing abrasive medium; said filling container being arranged to feed said pressure container by gravity and without the use of air.

* * * * *